US010289066B2

(12) United States Patent
Takahashi et al.

(10) Patent No.: US 10,289,066 B2
(45) Date of Patent: May 14, 2019

(54) IMAGE FORMING APPARATUS

(71) Applicant: CANON KABUSHIKI KAISHA, Tokyo (JP)

(72) Inventors: Satoru Takahashi, Kawasaki (JP); Yuichiro Inaba, Chigasaki (JP); Takeo Kawanami, Kamakura (JP); Tetsuji Suzuki, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/813,609

(22) Filed: Nov. 15, 2017

(65) Prior Publication Data

US 2018/0150024 A1 May 31, 2018

(30) Foreign Application Priority Data

Nov. 25, 2016 (JP) ..... 2016-228759
Mar. 3, 2017 (JP) ..... 2017-040035

(51) Int. Cl.

| | |
|---|---|
| ***G03G 21/18*** | (2006.01) |
| ***G03G 15/16*** | (2006.01) |
| ***G03G 15/02*** | (2006.01) |
| ***G03G 15/20*** | (2006.01) |
| ***G03G 15/00*** | (2006.01) |
| *G03G 21/16* | (2006.01) |

(52) U.S. Cl.

CPC ..... *G03G 21/1857* (2013.01); *G03G 15/0291* (2013.01); *G03G 15/1615* (2013.01); *G03G 15/80* (2013.01); *G03G 21/1842* (2013.01); *G03G 15/2064* (2013.01); *G03G 21/1652* (2013.01); *G03G 21/1666* (2013.01)

(58) Field of Classification Search

CPC ..... G03G 21/1857; G03G 21/1842; G03G 15/0291; G03G 15/1615; G03G 15/2064; G03G 15/80

See application file for complete search history.

(56) References Cited

U.S. PATENT DOCUMENTS

| | | | | |
|---|---|---|---|---|
| 6,975,814 | B2 | 12/2005 | Tsusaka et al. | |
| 2004/0096229 | A1* | 5/2004 | Yoshihara | H05K 7/20145 399/33 |
| 2004/0131378 | A1* | 7/2004 | Hattori et al. | G03G 15/80 399/90 |

FOREIGN PATENT DOCUMENTS

| | | |
|---|---|---|
| JP | 2001-235919 A | 8/2001 |
| JP | 2001-260469 A | 9/2001 |
| JP | 2004-102165 A | 4/2004 |
| JP | 2005-084161 A | 3/2005 |

* cited by examiner

*Primary Examiner* — Gregory H Curran
(74) *Attorney, Agent, or Firm* — Venable LLP

(57) ABSTRACT

An image forming apparatus includes an image bearing drum; an exposing unit for exposing the drum; an electric circuit board provided substantially perpendicularly to an apparatus installing floor; a driving unit for supplying a driving force; a first metal plate supporting the exposing unit; a second metal plate supporting the electric circuit board; and a third metal plate supporting the driving unit. At least one of the first, second and third plates is provided at each of four sides of the apparatus, the four sides being substantially perpendicular to the floor. The first, second and third plates are electrically connected with each other.

10 Claims, 11 Drawing Sheets

IMAGE FORMING APPARATUS

FIELD OF THE INVENTION AND RELATED ART

The present invention relates to an image forming apparatus such as a printer and a copying machine.

An image forming apparatus is provided with a circuit board and a driving unit. The circuit board, and the motor with which the driving unit is provided, could be a source of electromagnetic noises. The electromagnetic noises from the circuit board, and those from the motor of the driving unit, sometimes affect not only the internal components of the image forming apparatus, but also external devices which are in the adjacencies of the image forming apparatus. Further, it is possible that the electromagnetic noises from outside an image forming apparatus will affect the circuit board of the apparatus in terms of electrical operation.

There is disclosed in Japanese Laid-open Patent Application No. 2001-235919, an image forming apparatus structured so that its electrical unit, and its motor as a driving force source, are on the bottom side of its recording medium passage, and also, that its cables which also are sources of electromagnetic noises are shorter than those in the comparative image forming apparatuses.

One of the means for reducing an image forming apparatus in size, weight, and cost is to use resin or the like substance as the material for the conveyance guides for the recording medium passage, and also, the material for the lateral plates having guide rails for guiding a process cartridge when the cartridge is installed into the main assembly of the image forming apparatus, and integrally mold the conveyance guides and lateral plates. In such a case, it is mandatory that the image forming apparatus is provided with some means for dealing with electromagnetic noises. One of the means for dealing with electromagnetic noises is to provide an image forming apparatus with a vertical metallic shield (or multiple vertical metallic shields), in addition to the vertical exterior walls of the apparatus. In such a case, the image forming apparatus is structured so that the metallic shield faces all four external walls of the apparatus (metallic shields face four external walls one for one). This kind of setup, however, is problematic in that it increases an image forming apparatus in size and weight.

SUMMARY OF THE INVENTION

The present invention was made to solve the problems described above. Thus, the primary object of the present invention is to provide an image forming apparatus which is not undesirably affected by electromagnetic noises, and yet, is no greater in size than any conventional image forming apparatus.

According to an aspect of the present invention, there is provided an image forming apparatus comprising an image bearing member; an exposing unit configured to expose said image bearing member; an electric circuit board provided such that a plane of said electric circuit board is substantially perpendicular to a surface on which the image forming apparatus is placed; a driving unit configured to supply a driving force; a first metal plate supporting said exposing unit; a second metal plate supporting said electric circuit board; and a third metal plate supporting said driving unit, wherein at least one of said first metal plate, said second metal plate and said third metal plate is provided at each of four sides of said image forming apparatus, the four sides being substantially perpendicular to the surface on which said apparatus is placed, and wherein said first metal plate, said second metal plate and said third metal plate are electrically connected with each other.

Further features of the present invention will become apparent from the following description of exemplary embodiments with reference to the attached drawings.

DESCRIPTION OF THE EMBODIMENTS

Hereinafter, the present invention is concretely described with reference to a few of the preferred embodiments of the present invention.

Embodiment 1

Figure 1:
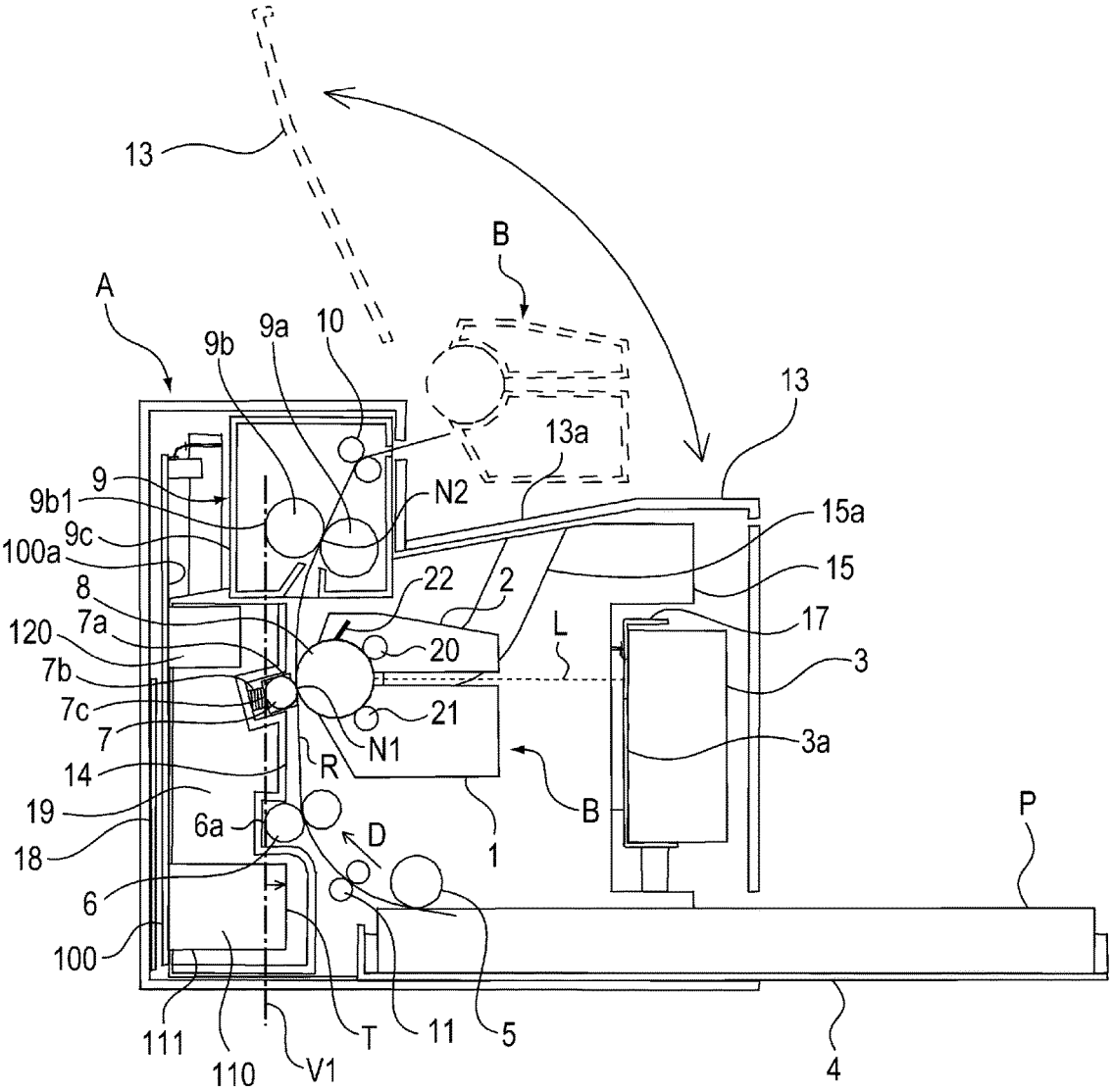
FIG. 1 is a sectional view of the image forming apparatus in the first embodiment of the present invention, which shows the structure of the image forming apparatus.
Figure 2:
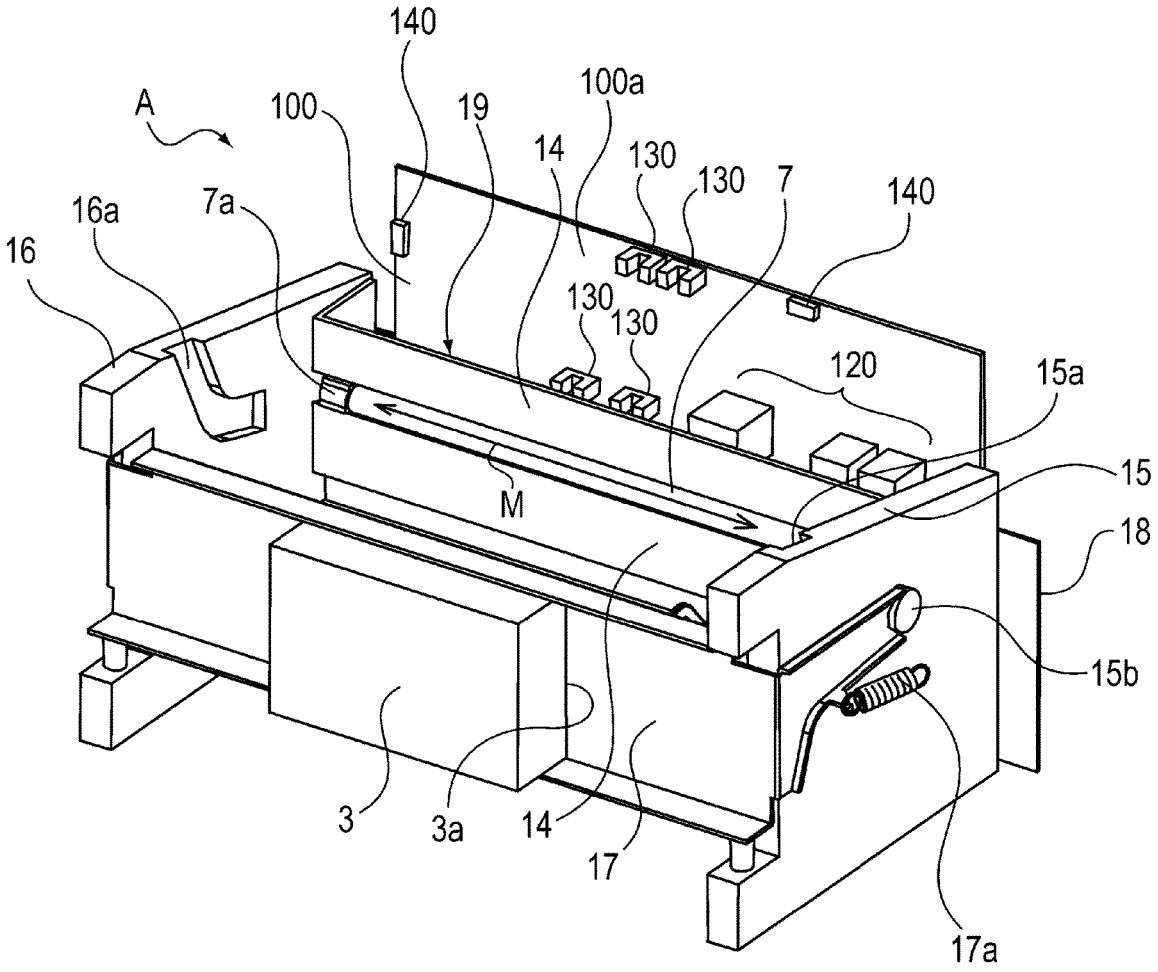
FIG. 2 is a perspective view of the image forming apparatus in the first embodiment, as diagonally seen from the side of one of the lateral plates of the main frame of the apparatus; it shows the structure of the main frame of the apparatus.

To begin with, referring to FIGS. 1-7, the image forming apparatus in the first embodiment of the present invention is described about its structure. FIG. 1 is a sectional view of the image forming apparatus in the first embodiment of the present invention. It shows the structure of the apparatus. FIG. 2 is a perspective view of the image forming apparatus in the first embodiment, as seen from the side of one of the side walls of the main frame of the apparatus. It shows the structure of the frame.

Figure 3:
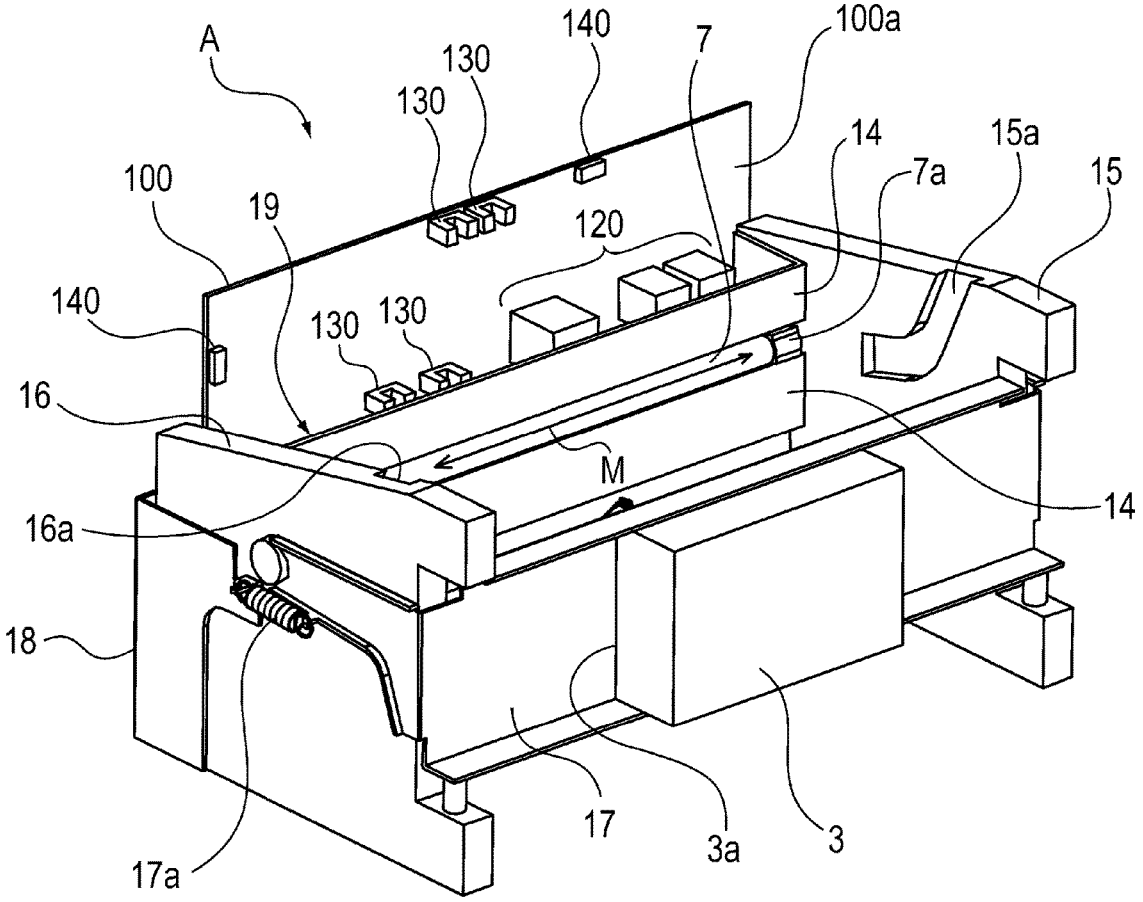
FIG. 3 is a perspective view of the image forming apparatus in the first embodiment, as diagonally seen from the side of other of the lateral plates of the main frame of the apparatus; it shows the structure of the main frame of the apparatus.
Figure 4:
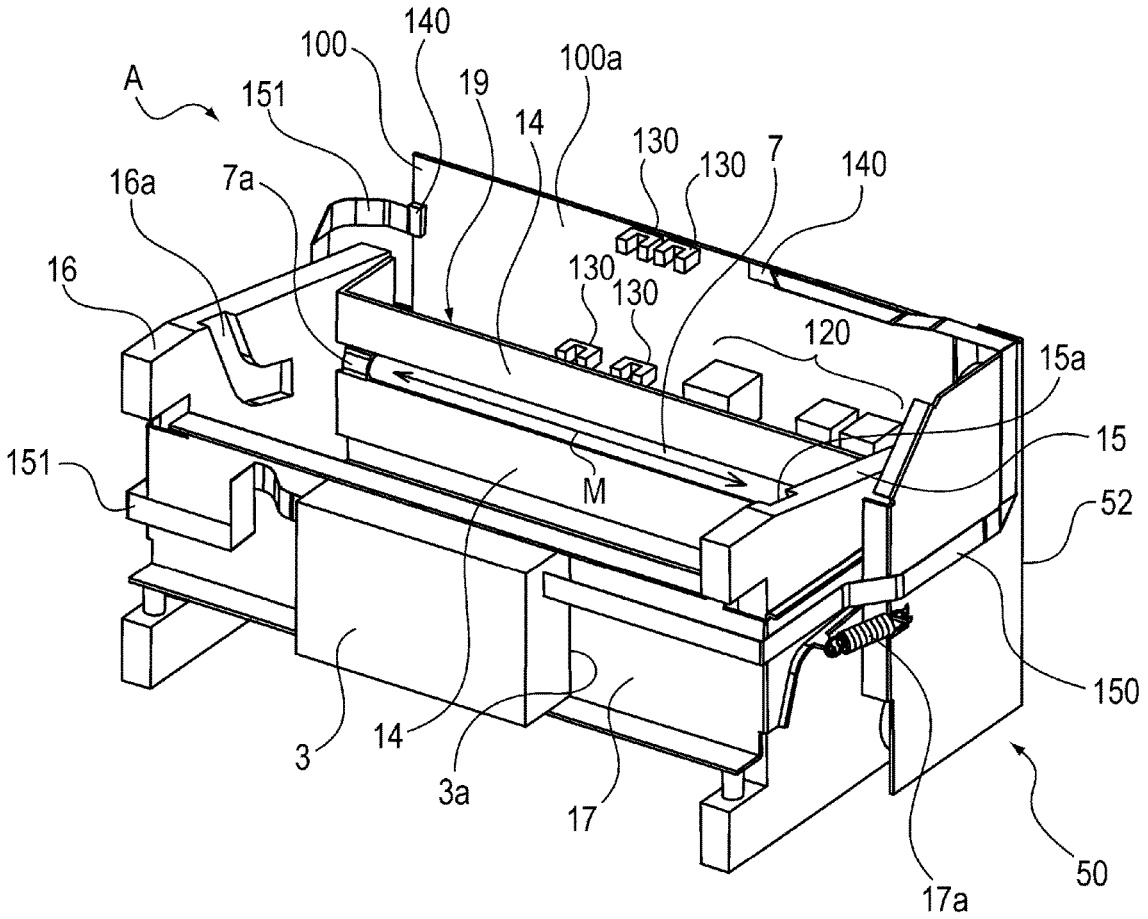
FIG. 4 is a perspective view of a combination of the main frame of the image forming apparatus shown in FIG. 2, the driving unit of the apparatus, and the image signal lines, after the attachment of the latter two to the main frame; it shows the structure of the combination.
Figure 5:
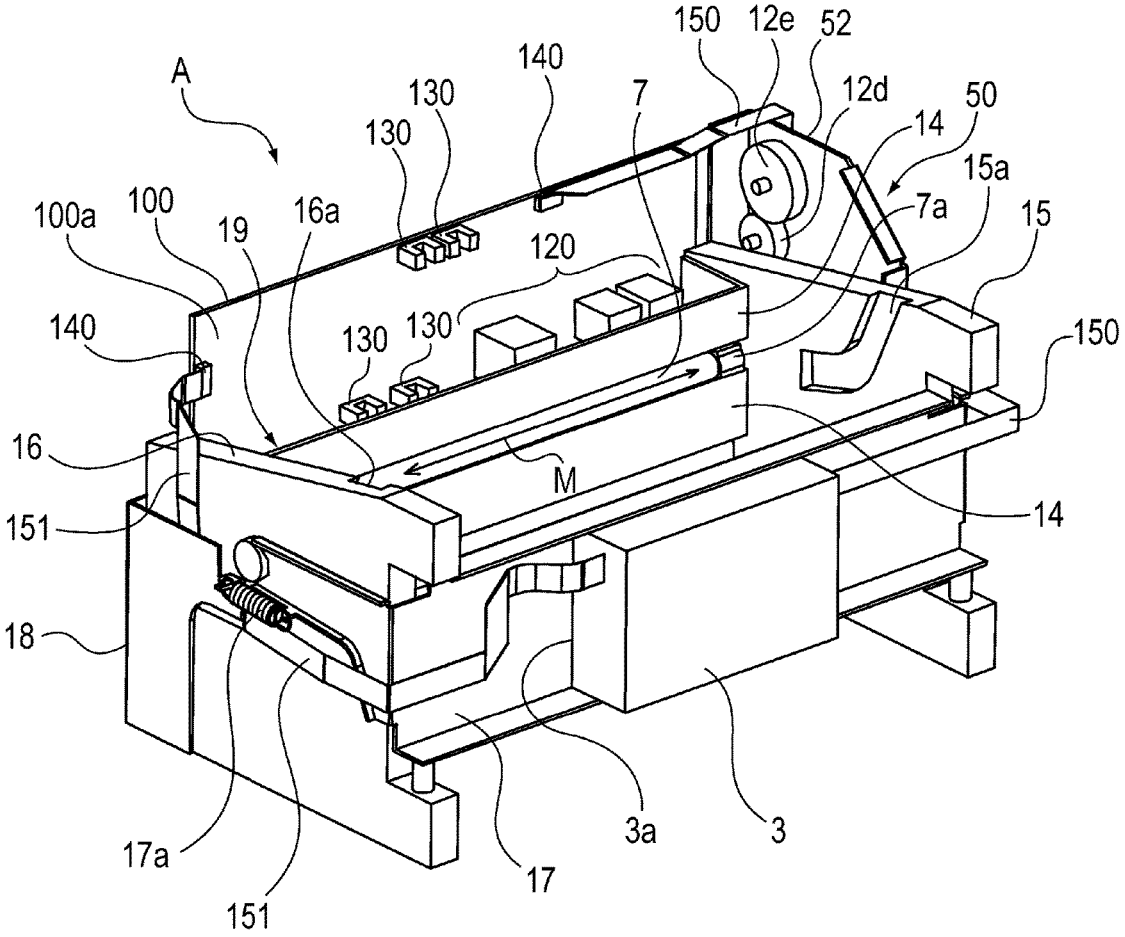
FIG. 5 is a perspective view of a combination of the main frame of the image forming apparatus shown in FIG. 3, the driving unit of the apparatus, and the image signal lines, after the attachment of the latter two to the main frame; it shows the structure of the combination.
Figure 6:
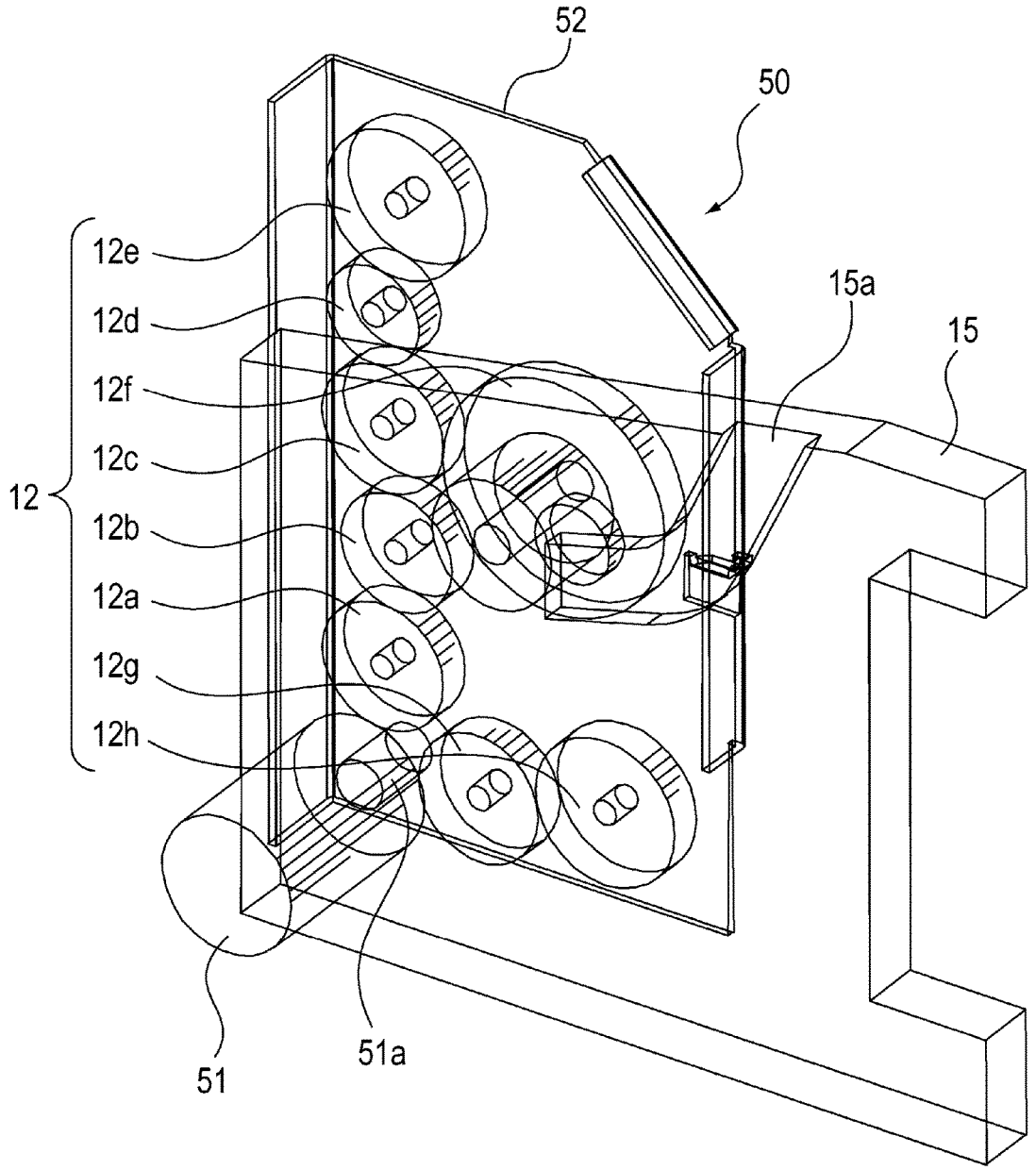
FIG. 6 is a perspective view of the driving unit in the first embodiment; it shows the structure of the driving unit.
Figure 7:
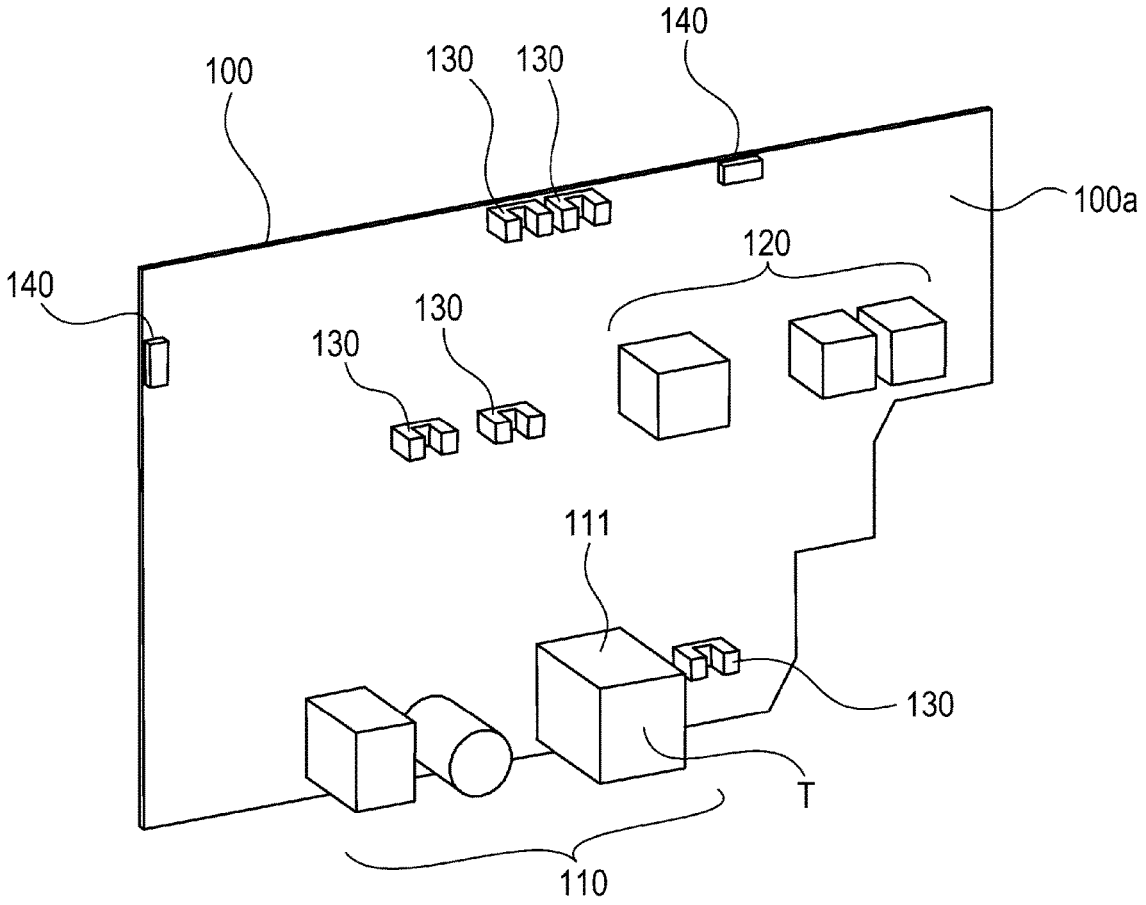
FIG. 7 is a perspective view of the circuit board in the first embodiment; it shows the structure of the board.

FIG. 3 is a perspective view of the image forming apparatus in the first embodiment, as seen from the side of the other side wall of the main frame of the apparatus. It shows the structure of the frame. FIG. 4 is a combination of the main frame of the image forming apparatus shown in FIG. 2, the driving unit of the apparatus, the image signal lines, after the attachment of the latter two to the main frame. FIG. 5 is a combination of the main frame of the image forming apparatus shown in FIG. 3, the driving unit of the apparatus, and the image signal lines, after the attachment of the latter two to the main frame. FIG. 6 is a perspective view of the driving unit in the first embodiment. It shows the structure of the driving unit. FIG. 7 is a perspective view of the circuit board of the image forming apparatus in the first embodiment. It shows the structure of the board.

<Image Forming Apparatus>

First, referring to FIG. 1, the image forming apparatus in this embodiment is described about the structure of its main assembly A. The main assembly A of the image forming apparatus shown in FIG. 1 is an example of laser beam printer, which employs an electrophotographic method for image formation. The image forming apparatus shown in FIG. 1 is structured so that a process cartridge B is removably installable in the main assembly A of the apparatus. The process cartridge B is such a cartridge that integrally contains a photosensitive drum 8 (image bearing member), a charge roller 20 (charging means), a developing apparatus 1 (developing means), a cleaner 2 (cleaning means), etc.

The image forming apparatus is provided with a door 13, which is rotatably supported by the top portion of the main assembly A of the apparatus. As the door 13 is opened as indicated by a pair of dotted lines in FIG. 1, it becomes possible for the process cartridge B to be removably installed in the main assembly A. The image forming apparatus is also provided with a laser scanner 3, which is an exposing apparatus for exposing the peripheral surface of the photosensitive drum 8 (image bearing member). The laser scanner 3 is disposed in the main assembly A.

The image forming apparatus is also provided with a feeder tray 4, in which sheets P of recording medium are stored. The feeder tray 4 is disposed in the bottom portion of the main assembly A. The main assembly A is provided with a sheet conveyance passage R, through which a sheet P of recording medium is conveyed. Further, the main assembly A is provided with a feed roller 5, a pair of conveyance rollers 5, and a pair of registration rollers 6, listing from the downstream side with respect to the direction, indicated by an arrow mark A in FIG. 1, in which the sheet P of recording medium is conveyed.

Further, the main assembly A is provided with a transfer roller 7, which is a transferring means for transferring a toner image formed on the peripheral surface of the photosensitive drum 8, onto a sheet P of recording medium. Moreover, it is provided with a fixing apparatus 9, which is a fixing means for fixing the toner image to the sheet P of recording medium, and a pair of discharge rollers 10, etc. With respect to the abovementioned recording medium conveyance direction, the transfer roller 7, the combination of the heat roller 9*a* and pressure roller 9*b* of the fixing apparatus 9, and the pair of discharge rollers 10 are disposed in the order in which they were mentioned.

<Image Forming Operation>

As the photosensitive drum 8 is rotated in the clockwise direction of FIG. 1, the peripheral surface of the photosensitive drum 8 is uniformly charged by the charge roller 20 (charging means). Then, a beam L of laser light is projected, while being modulated with the information of the image to be formed, upon the uniformly charged portion of the peripheral surface of the photosensitive drum 8, from the laser scanner (exposing means). Consequently, an electrostatic latent image is formed on the peripheral surface of the photosensitive drum 8. Then, the electrostatic latent image on the peripheral surface of the photosensitive drum 8 is supplied with toner (developer) by a development roller 21 (developer bearing member) disposed in the developing apparatus 1 (developing means). Thus, the electrostatic latent image is developed into a visible image, that is, an image formed of toner (developer). This visible image is referred to as toner image, hereafter.

Meanwhile, the rotational driving force from the motor 51 is transmitted to the feed roller 5 by the driving unit 50 shown in FIG. 6, in synchronism with the timing with which the beam L of laser light is outputted from the laser scanner 3. Thus, the sheets P of recording medium in the sheet feeder tray 4 are pulled out of the tray 4 one by one, while being separated from the rest of the sheets P, by the coordination between the feed roller 5 and an unshown sheet-separating means, in synchronism with the timing with which the beam L of laser light is outputted from the laser scanner 3. Then, each sheet P of recording medium is conveyed further by the pair of sheet conveyance rollers 11, while remaining pinched by the rollers 11, to the pair of registration rollers 6 which are remaining stationary. As the leading edge of the sheet P comes into contact with the nip between the pair of registration rollers 6, it is corrected in attitude (if it was being conveyed askew). Then, the pair of registration roller 6 is rotated with preset timing. Thus, the sheet P of recording medium is conveyed by the pair of registration rollers 6 to a transfer nip N1 formed by the photosensitive drum 8, and the transfer roller 7 (transferring means).

Thus, the sheet P of recording medium is conveyed by the pair of registration rollers 6 to the transfer nip N1, while remaining pinched by the pair of registration rollers 6, to the transfer nip N1, in synchronism with the arrival of the toner image formed on the peripheral surface of the photosensitive drum 8, at the transfer nip N1. Thus, the sheet P and the toner image on the photosensitive drum 8 are conveyed together through the transfer nip N1. While they are conveyed together through the transfer nip N1, transfer bias is applied to the transfer roller 7 from an unshown transfer bias source. Thus, the toner image on the peripheral surface of the photosensitive drum 8 is transferred onto the sheet P by the transfer bias. The toner remaining on the peripheral surface of the photosensitive drum 8 after the transfer is removed (scraped away) by a cleaning blade 22 (cleaning means).

After the transfer of the toner image onto the sheet P of recording medium, the sheet P is conveyed to the fixing apparatus 9 (fixing means) by the rotation of the photosensitive drum 8, while remaining pinched between the photosensitive drum 8 and transfer roller 7. Then, the sheet P, which is bearing the toner image at this point of the image forming operation, is conveyed through the fixing apparatus 9 while remaining pinched between the heat roller 9*a* and pressure roller 9*b* of the fixing apparatus 9. While the sheet P is conveyed through the fixing apparatus 9, the toner image on the sheet P is heated and pressed by the two rollers 9*a* and 9*b*. Consequently, the toner image is thermally fixed to the sheet P.

Thereafter, the sheet P of recording medium is conveyed further by the pair of discharge rollers 16 while remaining pinched by the pair of discharge rollers 16, and then, is discharged onto a delivery tray 13*a*, which is a part of the top surface of the door 13, by the pair of discharge rollers 16.

The main assembly A of the image forming apparatus is provided with a sheet conveyance guide 14 which provides the sheet passage R, and a stay 17 to which the laser scanner 3 is fixed. The sheet conveyance guide 14 and stay 17 are attached to the main assembly A of the image forming apparatus in such an attitude that their lengthwise direction is parallel to the lengthwise direction (left-right direction of FIG. 2) of the main assembly A. Further, the main assembly A is provided with a pair of side plates 15 and 16, which are in connection to the lengthwise ends (left-right direction of FIG. 2) of the sheet conveyance guide 14, one for one, and the lengthwise ends of the stay 17, one for one, by their lengthwise ends (left-right direction of FIG. 2). Furthermore, the main assembly A is provided with a pair of guide rails 15*a* and 16*a*, which are disposed on the inward side of the side plate 15 and that of the side plate 16, to guide the process cartridge B when the process cartridge B is installed into, or uninstalled from, the main assembly A.

Referring to FIGS. 4 and 5, there is disposed the aforementioned driving unit 50 on the outward side of the side plate 15. Referring to FIGS. 2-5, there is disposed the aforementioned circuit board 100 on the outward side of the sheet conveyance guide 14, perpendicular to the surface on which the main assembly A of the image forming apparatus is placed.

<Frame Structure>

Next, referring to FIGS. 2-5, the frame of the main assembly A of the image forming apparatus is described about its structure. The direction indicated by an arrow mark M in FIGS. 2-5 is parallel to the lengthwise direction of the main assembly A of the image forming apparatus, and also, to the axial line of each of such a roller as the transfer roller 7 that conveys the sheet P of recording medium.

The laser scanner 3 (exposing apparatus) in this embodiment is fixed to the stay 17 (first metallic plate), which is electrically conductive and is U-shaped in cross-section. More specifically, it is fixed to the outward surface of the stay 17 with the use of such fixing means as small screws. The surface of the stay 17, to which the laser scanner 3 is attached is roughly perpendicular to the surface on which the main assembly A is placed. Referring to FIGS. 2 and 3, the stay 17 is under the tension generated by a pair of tension springs 17*a* (pressure applying means), which are disposed on the outward side of the side plates 15 and 16, one for one.

One of the lengthwise ends of one of the pair of tension springs 17*a* which keep the stay 17 pressed toward the corresponding side plate 15 (or 16) of the main assembly A is attached to the corresponding lengthwise end of the stay 17, whereas the corresponding lengthwise end of the other tension spring 17*a* is anchored to the other lengthwise end of the stay 17. More specifically, the opposite lengthwise end of one of the pair of tension springs 17*a* from the lengthwise end by which the tension spring 17*a* is attached to the stay 17, is anchored to the electrically conductive metallic plate 52 shown in FIG. 4, whereas the opposite end of the other tension spring 17*a* from the lengthwise end by which the tension spring 17*a* is attached to the stay 17, is anchored to the electrically conductive metallic plate 18 shown in FIG. 15. By the way, each of the pair of tension springs 17*a* is an electrically conductive elastic member.

The circuit board 100 is on the rear side of the main assembly A. It is attached to the outward surface of the sheet conveyance guide 14, with the use of such fixing means as small screws. The circuit board 100 is disposed so that its primary surfaces are roughly perpendicular to the surface on which the main assembly A of the image forming apparatus is set. That is, the circuit board 100 is disposed in parallel to the direction indicated by the arrow mark M. Referring to FIG. 1, the surface 3*a* of the laser scanner 3 (exposing apparatus), which faces the stay 17 as the laser scanner 3 is attached to the stay 17, is roughly parallel to the surface on which the main assembly A is set. Thus, the surface 3*a* of the laser scanner 3 is roughly parallel to the primary surfaces 100*a* of the substrate of the circuit board 100. Referring to FIGS. 2-5, the laser scanner 3 (exposing apparatus) and circuit board 100 are disposed roughly in parallel to each other, in the main assembly A of the image forming apparatus.

<Driving Unit>

Next, referring to FIG. 6, the driving unit 50 is described about its structure. Referring to FIGS. 4 and 6, there is provided the driving unit 50 on the outward side of the side plate 15. The driving unit 50 supplies driving force to each of various portions of the image forming apparatus, which needs to be driven. Referring to FIG. 6, it is made up of the aforementioned electrically conductive metallic plate 52 (third metallic plate), and a gear train supported by the metallic plate 52. That is, multiple gears 12*a*-12*h* are rotatably supported by the metallic plate 52.

To the side plate 15, the aforementioned motor 51, which is a driving force source, is fixed with the use of unshown small screws or the like fixing members. The driving gear 51*a* is fixed to the shaft of the motor 51, and is in mesh with gears 12*a* and 12*g*. The gear 12*a* is in mesh with a gear 12*b*, which is in mesh with a gear 12*c*, which is in mesh with gears 12*d* and 12*f*. Further, the gear 12*d* is in mesh with a gear 12*e*. Furthermore, the gear 12*g* is in mesh with a gear 12*h*.

Thus, the rotational driving force from the motor 51 is transmitted to each of the feed roller 5, pair of conveyance rollers 11, pair of registration rollers 6, photosensitive drum 8, heat roller 9*a*, pressure roller 9*b*, and pair of discharge rollers 10, which are shown in FIG. 1, by way of the gear train 1 made up of multiple gears 12*a*-12*h*.

Referring to FIGS. 2-5, the lengthwise end portions of the transfer roller 7 are rotatably supported by the lengthwise end portions of the sheet conveyance guide 14, one for one, with the placement of a pair of bearings 7*a* between the lengthwise end portions of the transfer roller 7 and those of the sheet conveyance guide 14, one for one. The main assembly A is structured so that the transfer roller 7 is kept pressed upon the peripheral surface of the photosensitive drum 8 by a pair of compression springs 7*b* (pressure applying means) attached to the pair of bearings 7*a*, one for one, in order to provide a preset amount of contact pressure between the peripheral surface of the transfer roller 7 and that of the photosensitive drum 8.

The transfer roller 7 forms the transfer nip N1 by being pressed upon the peripheral surface of the photosensitive drum 8. To the transfer roller 7, transfer bias is applied from an unshown electrical power source for the transfer bias. Thus, the toner image formed on the peripheral surface of the photosensitive drum 8 is transferred onto the sheet P of recording medium conveyed to the transfer nip N1 by the pair of registration rollers 6 while remaining pinched by the pair of registration rollers 6. The transfer roller 7 supported by the sheet conveyance guide 14 is not in connection to the gear train shown in FIG. 6. It is rotated by the rotation of the photosensitive drum 8.

After the transfer of the toner image onto the sheet P of recording member in the transfer nip N1, the sheet P is conveyed to the fixing apparatus 9 through the recording medium conveyance passage R. The fixing apparatus 9 is provided with a frame 9*c* and a pair of rollers, more specifically, a pressure roller 9*b* and a heat roller 9*c*, which are rotatably supported by the frame 9*c*. The frame 9*c* of the fixing apparatus 9 is fixed to the top surface portion of the side plate 15 and that of the side plate 16 with the use of unshown small screws or the like fixing members. To one of the lengthwise ends of the rotational shaft of the pressure roller 9*b*, an unshown driving gear is fixed. The driving gear of the pressure roller 9*b* is in mesh with the gear 12*d* of the gear train 12 shown in FIG. 6. Thus, the pressure roller 9*b* is rotated by the rotational driving force transmitted to the pressure roller 9*b* from the motor 51 (driving force source) by way of the gear train 12.

After the transfer of the toner image onto the sheet P of recording medium in the transfer nip N1, the sheet P is heated and pressed while it is conveyed through the fixation nip N2 formed by the combination of the heat roller 9*a* and pressure roller 9*b*. Consequently, the toner image melts, and becomes fixed to the sheet P as it cools down. Thereafter, the sheet P, which is bearing the fixed toner image, is conveyed further by the pair of discharge rollers 10 while remaining pinched by the pair of discharge rollers 10, and then, is discharged into a delivery tray 13*a*, with which the aforementioned door 13 is provided.

<Circuit Board>

Next, referring to FIG. 7, the circuit board 100 is described about its structure. The circuit board 100 shown in FIG. 7 is provided with a low voltage power source portion 110, which draws AC power from an external commercial power source, and converts the AC power into DC power. The circuit board 100 is also provided with a high voltage power source portion 120 for supplying the process cartridge B and transfer roller 7 with high voltage, which is necessary for image formation.

The circuit board 100 in this embodiment is made up of electrical elements, and a substrate to which the electrical elements are integrally attached. The electrical elements include the electrical elements of the low voltage power source element 110 and those of the high voltage power source portion 120. The circuit board 100, shown in FIG. 7, is also provided with multiple sensors 130 for detecting the state of the sheet P of recording medium while the sheet P is conveyed through the sheet passage R. Further, it is provided with a connector portion 140, etc., to which a pair of image signal lines 150 and 151 are connected to send image formation signals to the laser scanner 3.

In this embodiment, the multiple electrical elements of the low voltage power source portion 110, and those of the high voltage power source portion 120, are perpendicularly mounted on the surface 100*a* of the substrate of the circuit board 100. Among these electrical elements, the tallest one with reference to the surface 100*a* of the substrate of the circuit board 100 is the low voltage power source transformer 111, which is a part of the low voltage power source portion 110. That is, the top portion T of the low voltage power source transformer 111 protrudes farthest from the circuit board 100 in terms of the direction which is perpendicular to the circuit board 100.

The circuit board 100 is disposed roughly in parallel to the sheet passage R for the sheet P, which is parallel to the vertical direction in FIG. 1. The circuit board side of the sheet passage R is the sheet conveyance guide 14, which is positioned so that it extends in the vertical direction as well as the widthwise direction, in FIG. 1. There is a space 19 between the surface 100*a* of the substrate of the circuit board 100, and the sheet conveyance guide 14. The low voltage power source portion 110 and high voltage power source portion 120, which are made up of the electrical elements mounted on the substrate of the circuit board 100, are accommodated by the space 19 formed between the sheet conveyance guide 14 and circuit board 100.

Referential codes 6*a*, 7*c* and 9*b*1 stand for points at which the peripheral surface of one of the pair of conveyance rollers 11, that of one of the pair of registration rollers 6, that of the transfer roller 7, and that of the pressure roller 9*b* are closest to the surface 100*a* of the substrate of the circuit board 100, respectively (point at which peripheral surface of conveyance roller is closest to surface 100*a* is not shown). A referential code V1 stands for a plane which coincides with the closest of the points 6*a*, 7*c* and 9*b*1 to the circuit board 100, and parallel to the surface 100*a* of the substrate of the circuit board 100. The interior of the main assembly A is structured so that the farthest point T of the low voltage power source transformer 11 from the surface 100*a* is on the sheet passage R side (right side in FIG. 1) of the plane V1.

Thus, the main assembly A of the image forming apparatus does not need to be widened in the front-rear direction (left-right direction in FIG. 1) to provide a space dedicated to accommodate the low voltage power source transformer 111. That is, the present invention can reduce an image forming apparatus in size.

Further, the low voltage power source portion 110, which includes the low voltage power source transformer 111, is disposed on the underside of the transfer roller 7 shown in FIG. 1. Thus, the center of gravity of the main assembly A is in the bottom portion of the main assembly A. Thus, the main assembly A is stable.

Further, the low voltage power source portion 110, which includes the low voltage power source transformer 111, is disposed away from the fixing apparatus 9 shown in FIG. 1. Thus, it is possible to prevent the problem that the image forming apparatus malfunctions due to the effects of the heat generated by the fixing apparatus 9. Further, as the air in the adjacencies of the low voltage power source portion 110 is heated, it flows upward (FIG. 1) through the space 19 between the sheet conveyance guide 14 and circuit board 100. Thus, the heat from the low voltage power source portion 110 is efficiently discharged out of the main assembly A.

<Countermeasure to Electromagnetic Noises>

Next, referring to FIGS. 4 and 5, the countermeasure to the electromagnetic noises generated in and outside an image forming apparatus is described. The circuit board 100 can be a source of electromagnetic noises. The electromagnetic noises generated by an image forming apparatus affect not only the internal components of the apparatus, but also the devices in the adjacencies of the image forming apparatus.

It is unreasonable to expect that simply fixing the circuit board 100 to the sheet conveyance guide 14, which is a nonconductive member as in this embodiment, is sufficient to block the electromagnetic noises. In other words, in a case where the circuit board 100 is simply fixed to the sheet conveyance guide 14, it is highly possible that the electromagnetic noises generated by the circuit board 100 will radially transmit to various portions of the image forming apparatus, and also, those outside the main assembly A. In this embodiment, however, the aforementioned electrically conductive metallic plate (second metallic plate), which is capable of blocking the electromagnetic noises which the circuit board 100 generates, is disposed on the outward side of the circuit board 100 (FIGS. 1 and 3). More specifically, the metallic plate 18 is fixed, along with the sheet conveyance guide 14, to the main assembly A of the image forming apparatus. The metallic plate 18 is long enough to span from one (15) of the pair of side plates to the other (16).

The metallic plate 18 (second metallic plate) is fixed to both the circuit board 100, and the electrically conductive metallic plate 52 (third metallic plate) shown in FIGS. 4 and 5, with the use of electrically conductive small screws or the like fixing members. There is electrical connection between the metallic plate 18 (second metallic plate) and metallic plate 52 (third metallic plate) through the electrically conductive stay 17 (first metallic plate) and pair of tension springs 17*a*. Further, there is electrical connection between the stay 17 and metallic plate 18, and between the stay 17 and metallic plate 52, through the pair of electrically conductive tension springs 17*a*. That is, the stay 17 (first metallic plate), metallic plate 18 (second metallic plate), and metallic plate 52 (third metallic plate) are connected to each other so that they remain the same in potential level. By the way, electrically conductive small screws or the like may be used to connect the stay 17 to metallic plate 18 to establish electrical connection between the stay 17 and metallic plate 18, and also, to connect the stay 17 to the metallic plate 52 to establish electrical connection between the stay 17 and metallic plate 52. Further, among the electrical connections among the stay 17 (first metallic plate), metallic plate 18 (second metallic plate), and metallic plate 52 (third metallic plate), at least one of them may be made by an elastic member such as an electrically conductive tension spring 17*a*.

In this embodiment, a combination of the metallic plate 18 (second metallic plate), metallic plate 52 (third metallic plate), and stay 17 (first metallic plate) surrounds the internal components of the image forming apparatus with respect to the four directions which are perpendicular to the side walls of the main assembly A, playing thereby the role of blocking the electromagnetic noises. Thus, not only are the electromagnetic noises generated in the image forming apparatus prevented from outwardly transmitting, but also, the electromagnetic noises generated outside the image forming apparatus are prevented from affecting the electrical operation of the circuit board 100. Moreover, it is possible to prevent the problem that the electromagnetic noises generated by the various electrical power source elements, etc., of the low voltage power source portion 110, which are on the substrate of the circuit board 100, and those of the high voltage power source portion 120, which also are on the substrate of the circuit board 100, affect the devices in the adjacencies of the image forming apparatus. As described above, it is desired that the image forming apparatus is provided with the stay 17 (first metallic plate), metallic plate 18 (second metallic plate), and metallic plate 52 (third metallic plate); each of the four sides, with respect to the direction perpendicular to the surface on which the image forming apparatus is placed, of the combination of the internal components of the apparatus is covered by at least one of these metallic plates; and these metallic plates are in electrical connection with each other.

Further, referring to FIGS. 4 and 5, in this embodiment, the image signal lines 150 and 151 for connecting the connector portion 140, with which the circuit board 100 is provided, to the laser scanner 3, are disposed so that they are in the adjacencies of the outward surface of the metallic plate 18, and also in the adjacencies of the outward surface of the metallic plate 52. Thus, it is possible to prevent the problem that the electromagnetic noises which generate from the various power source elements of the low voltage power source portion 110 and those of the high voltage power source portion 120, which are on the substrate of the circuit board 100, affect the image signal lines 150 and 151. Therefore, it is possible to protect the laser scanner 3 from the electromagnetic noises.

Comparative Example

Figure 9:
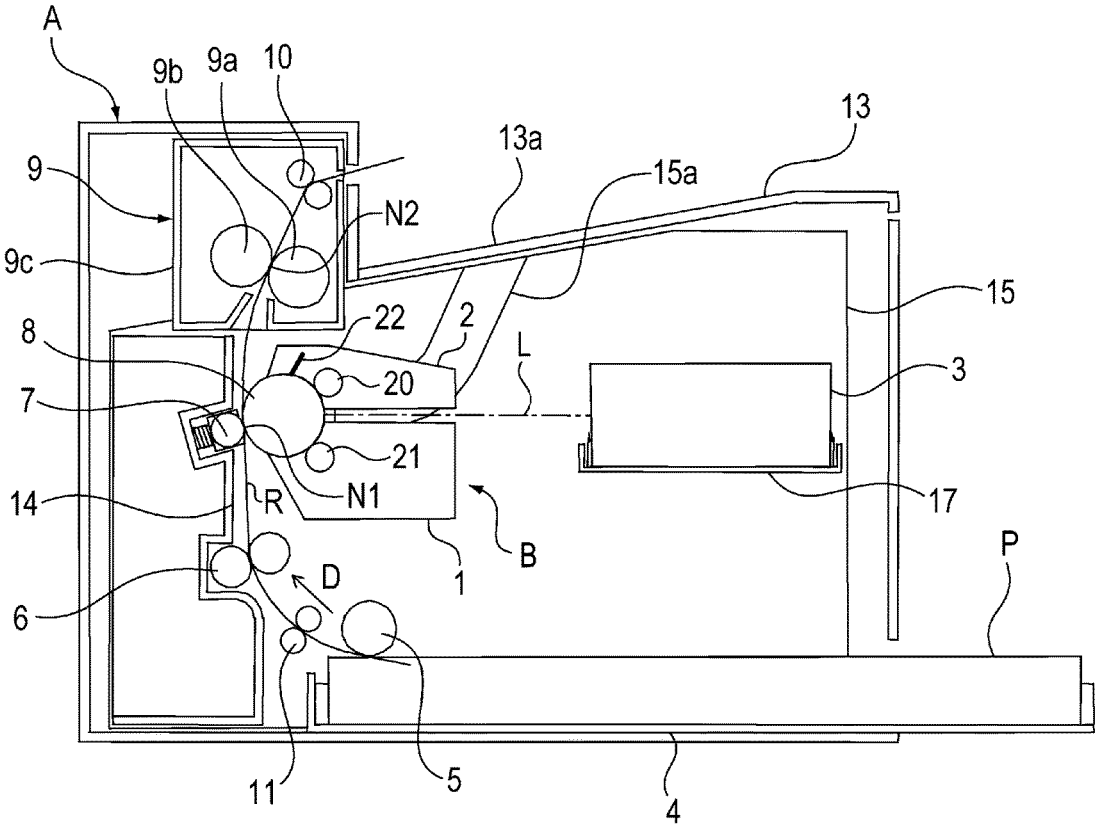
FIG. 9 is a sectional view of a comparative image forming apparatus; it shows the structure of the comparative apparatus.
Figure 10:
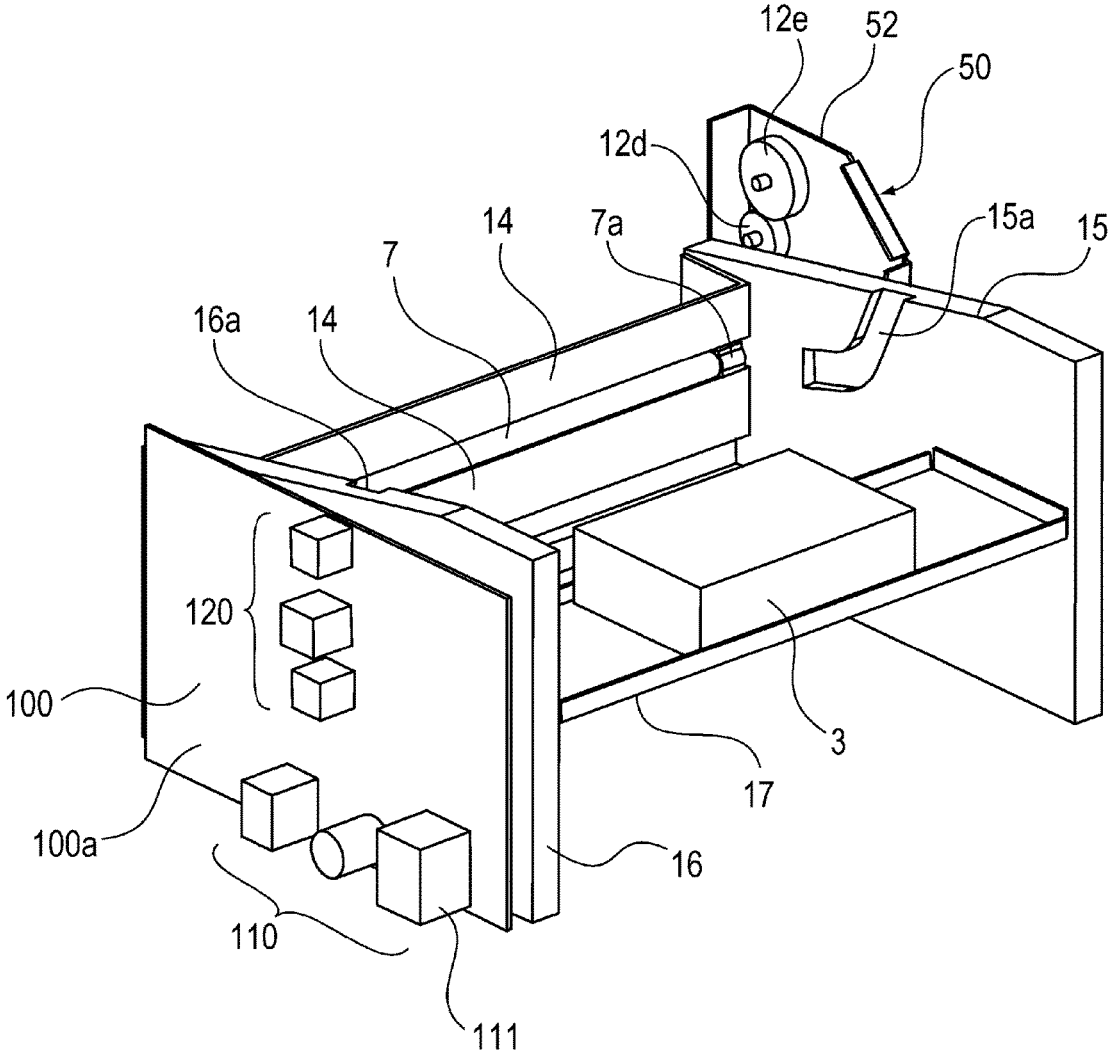
FIG. 10 is a sectional view of the comparative image forming apparatus; it shows the structure of the main frame structure of the apparatus.

Next, referring to FIGS. 9 and 10, one of comparative examples of image forming apparatus is described about its structure. FIG. 9 is a sectional view of one of the comparative examples of an image forming apparatus. It shows the structure of the main assembly A of the comparative image forming apparatus. FIG. 10 is a perspective view of a combination of the essential portions of the comparative image forming apparatus. It shows the structure of the main assembly A of the apparatus.

The main assembly A of the comparative image forming apparatus is also provided with the sheet conveyance guide 14 which makes up a part of the sheet passage R. However, the main assembly A of this image forming apparatus is structured so that the flat surface (scanner fixation surface) of the stay 17, to which the laser scanner 3 is fixed, is parallel to the surface on which the image forming apparatus is placed.

Further, the sheet conveyance guide 14 and stay 17 are attached by their lengthwise ends to the pair of mutually opposing side plates 15 and 16 which are left and right end portions of the main assembly A. Thus, the sheet conveyance guide 14 and stay 17 are supported by the pair of side plates 15 and 16. The aforementioned driving unit 50 is disposed on the outward side of the side plate 15. The circuit board 100 is disposed on the outward side of the side wall 16. The low voltage power source portion 110 and high voltage power source portion 120 are mounted on the surface 100*a* of the substrate of the circuit board 100 in such a manner that they protrude outward of the main assembly A of the image forming apparatus. Disposing the circuit board 100 in this manner requires an image forming apparatus to be increased in size.

In comparison, in the case of the image forming apparatus in this embodiment shown in FIG. 1, the circuit board 100 which is holding the multiple electrical elements of the low voltage power source portion 110 and those of the high voltage power source portion 120 is disposed on the rear side of the main assembly A of the image forming apparatus, and roughly perpendicular to the surface on which the image forming apparatus is set. Further, it is disposed in such an attitude that the tall power source elements, etc. of the low voltage power source portion 110 of the circuit board 100, and those of the high voltage power source portion 120 of the circuit board 100, protrude toward the sheet passage R, that is, frontward of the image forming apparatus.

Thus, these elements of the electrical power sources fit in the space 19 between the sheet conveyance guide 14 and circuit board 100. Thus, the main assembly A of the image forming apparatus is not required to be increased in size with respect to the front-rear direction (left-right direction of FIG. 1). That is, the present invention can provide an image forming apparatus which is substantially smaller in size than the comparative image forming apparatus shown in FIGS. 9 and 10.

Further, according to this embodiment of the present invention, even if the side plates 15 and 16 of an image forming apparatus are formed of a resinous substance, it is possible to deal with the electromagnetic noises from the internal sources of an image forming apparatus, and those from the devices which are outside the image forming apparatus, without increasing the apparatus in size.

Embodiment 2

Figure 8:
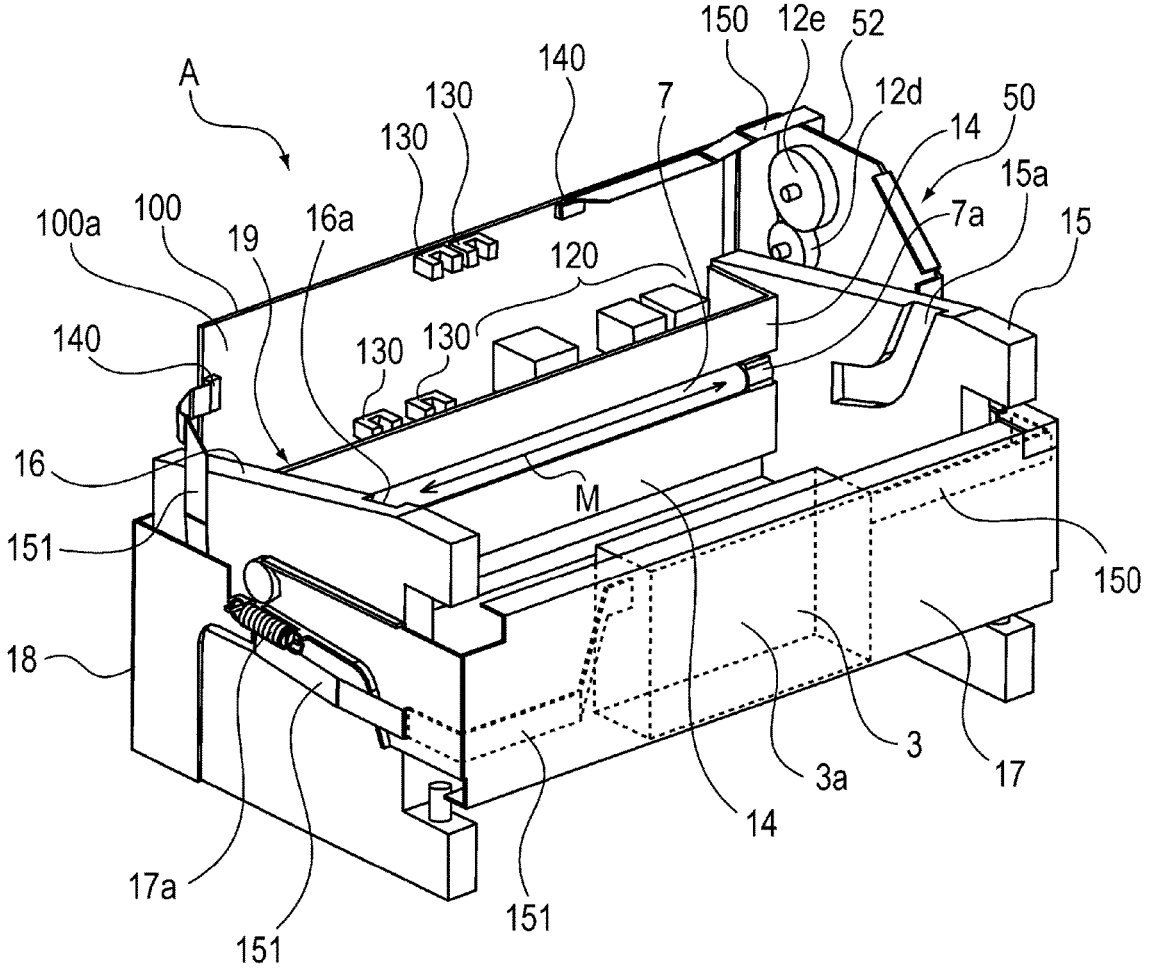
FIG. 8 is a perspective view of the image forming apparatus in the second embodiment of the present invention; it shows the structure of the apparatus.

Next, referring to FIG. 8, the image forming apparatus in the second embodiment of the present invention is described about its structure. FIG. 8 is a perspective view of the image forming apparatus in the second embodiment of the present invention. It is for showing the structure of the apparatus. By the way, the components of the image forming apparatus in this embodiment, and the parts thereof, which are the same in structure as the counterparts in the first embodiment, are given the same referential codes as those given to the counterparts, and are not described. Further, in a case where a given component of the image forming apparatus in the second embodiment is the same in structure as one of the components of the image forming apparatus in the first embodiment, it is not described even if the two components are different in referential code.

The image forming apparatus in the first embodiment was structured so that its scanner 3 was on the outward side of the main assembly A with reference to the stay 17. In comparison, the image forming apparatus in this embodiment is structured so that the stay 17 is disposed on the outward side of the main assembly A of the image forming apparatus with reference to the laser scanner 3. In this embodiment, the stay 17, which is U-shaped in cross-section, is disposed so that its bottom portion, with reference to its U-shaped cross-section, is perpendicular to the surface on which the apparatus is set; the inward surface of the bottom portion faces inward of the main assembly A of the image forming apparatus; and the laser scanner 3 is fixed to the inwardly facing surface of the bottom portion of the stay 17 with the use of small screws or the like fixing means, being thereby supported by the stay 17.

Also in this embodiment, the metallic plate 18, metallic plate 52, and stay 17, which are electrically conductive, are disposed so that they are roughly perpendicular to the surface, on which the image forming apparatus is set, and also, so that the internal components of the image forming apparatus, which generate electromagnetic noises, or are sensitive to electromagnetic noises, are surrounded from the four sides of the main assembly A with respect to the horizontal direction, by at least one of the metallic plate 18, metallic plate 52, and stay 17. Thus, the metallic plate 18, metallic plate 52, and stay 17 play a role of an electromagnetic noise blocking plate.

Further, in this embodiment, the stay 17, which is made to play the role of an electromagnetic noise blocking plate, is disposed on the outward side of the laser scanner 3. Thus, the image formation signal lines 150 and 151 are disposed in the adjacencies of the inward surface of the stay 17. Thus, the electrical operation of the laser scanner 3 is prevented from being affected by the electromagnetic noises.

Further, the electromagnetic noises which come from the sources which are outside the image forming apparatus are blocked by the stay 17, being therefore prevented from affecting the scanner motor, and the electrical operation of the laser board. Further, the electromagnetic noises which generate from within the laser scanner 3 are prevented from radiating out of the image forming apparatus. Otherwise, the second embodiment is the same as the first embodiment with respect to their structure, and is the same in effect as the first embodiment.

That is, according to the second embodiment of the present invention, the present invention makes it possible to provide an image forming apparatus which can deal with electromagnetic noises which come from internal sources as well as those from external sources, and yet, is no greater in size than any conventional comparable image forming apparatus.

Embodiment 3

Figure 11:
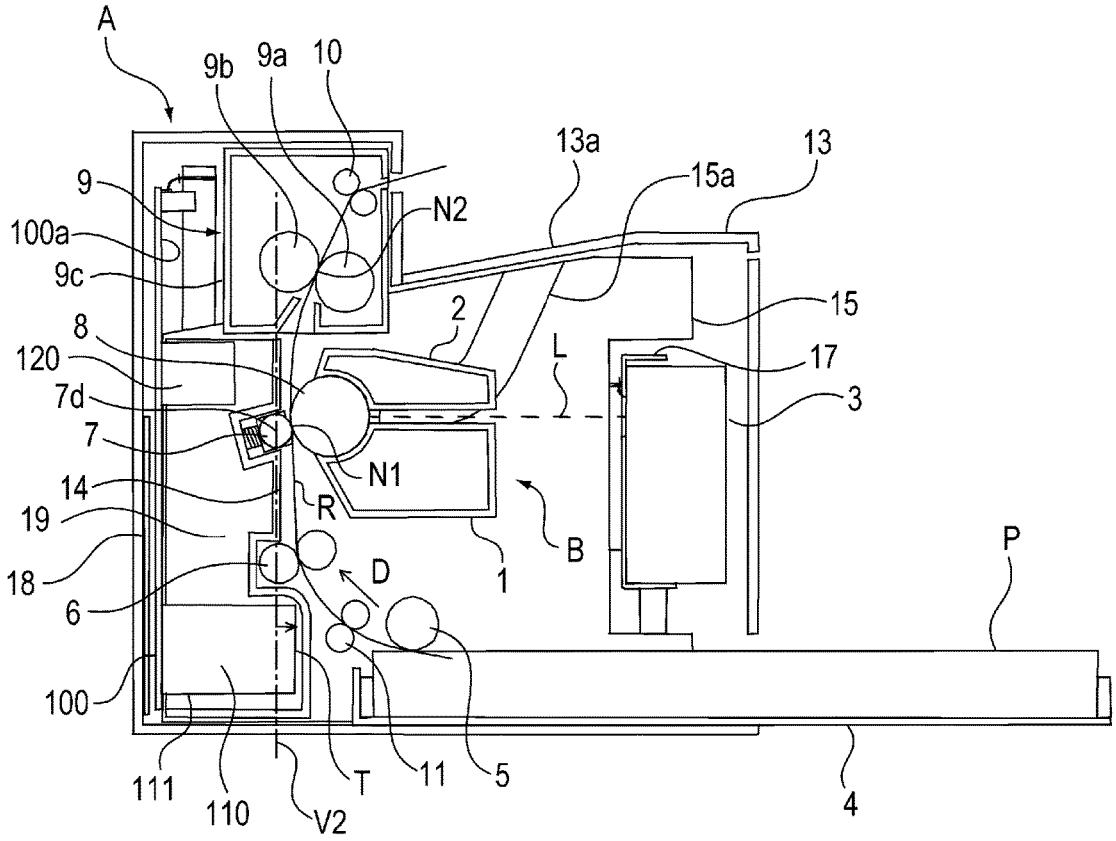
FIG. 11 is a sectional view of the image forming apparatus in the third embodiment of the present invention; it shows the structure of the apparatus.

Next, referring to FIG. 11, the image forming apparatus in the third embodiment of the present invention is described about its structure. By the way, the components of the image forming apparatus in this embodiment, and the parts thereof, which are the same in structure as the counterparts in the first embodiment described above, are given the same referential codes as those given to the counterparts in the first embodiment, and are not described. Further, in a case where a given component of the image forming apparatus in the third embodiment is the same in structure as one of the components of the image forming apparatus in the first embodiment, it is not described even if the two components are different in referential code. FIG. 11 is a sectional view of the image forming apparatus in the third embodiment of the present invention. It shows the structure of the main assembly A of the image forming apparatus. In the case of the image forming apparatus shown in FIG. 11, its circuit board 100 is disposed so that the highest point T of the low voltage power source transformer 111 of the low voltage power source portion 110 is protrusive toward the sheet passage R (rightward in FIG. 11) beyond a plane V2 which is coincident with the rotational axis 7*d* of the transfer roller 7 and is parallel to the surface 100*a* of the substrate of the circuit board 100.

That is, the circuit board 100 is disposed so that the highest point T of the low voltage power source transformer 111 which is the tallest electrical element among the multiple electrical elements on the circuit board 100 is protrusive toward the sheet passage R beyond the abovementioned plane V2, which is coincident with the rotational axis 7*d* of the transfer roller 7 disposed along the sheet passage R, and is parallel to the surface 100*a* of the substrate of the circuit board 100.

That is, the main assembly A of the image forming apparatus is structured so that the highest point T of the low voltage power source transformer 111 of the low voltage power source portion 110 on the circuit board 100 is more protrusive toward the sheet passage R than the counterpart of the image forming apparatus shown in FIG. 1. Thus, even if a circuit board (100) having a taller (larger) low voltage power source transformer (111) than those in the preceding embodiments is employed in place of the circuit board 100, it is unnecessary to increase the main assembly A of the image forming apparatus with respect to the front-rear direction (left-right direction in FIG. 11).

By the way, in this embodiment, the plane V2, or referential plane, was coincident with the rotational axis 7*d* of the transfer roller 7. However, this embodiment is not intended to limit the present invention in scope with respect to the position of the plane V2. That is, the plane V2 may be changed in position according to each of various image forming apparatuses A which are different in structure. For example, a plane which is coincident to the pressure roller 9*b*, or the rotational axis of the registration roller 6 which is closer to the circuit board 100, may be used as a referential plane, so that the highest point T of the low voltage power source transformer 111 of the low voltage power source portion 110 of the circuit board 100 protrudes toward the sheet passage R beyond this plane, instead of the plane V2.

Otherwise, the main assembly A of image forming apparatus in this embodiment is the same in structure as that in the first embodiment, and is the same in effect.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2016-228759 filed on Nov. 25, 2016 and 2017-040035 filed on Mar. 3, 2017, which are hereby incorporated by reference herein in their entirety.

What is claimed is:

1. An image forming apparatus comprising:

an image bearing member;

an exposing unit configured to expose said image bearing member;

an electric circuit board provided such that a plane of said electric circuit board is substantially perpendicular to a surface on which said image forming apparatus is placed;

a driving unit configured to supply a driving force;

a first metal plate supporting said exposing unit;

a second metal plate supporting said electric circuit board; and a third metal plate supporting said driving unit, wherein at least one of said first metal plate, said second metal plate and said third metal plate is provided at each of four sides of said image forming apparatus, the four sides being substantially perpendicular to the surface on which said image forming apparatus is placed, wherein said first metal plate, said second metal plate and said third metal plate are electrically connected with each other, and wherein at least one connecting portion between said first metal plate, said second metal plate and said third metal plate is connected with an electroconductive elastic member.

2. An apparatus according to claim 1, wherein said exposing unit and said circuit board extend substantially in parallel with each other in a main assembly of said image forming apparatus.

3. An image forming apparatus for forming an image on a recording material, said apparatus comprising:

a feeding path for feeding the recording material; and an electric circuit board provided extending substantially in parallel with said feeding path, wherein electrical elements provided on said electric circuit board are disposed in a space between said feeding path and said electric circuit board, wherein a top portion of a tallest one of said electrical elements is at a side of said feeding path beyond a plane parallel with a surface of said electric circuit board and passing through a closest portion, to said electric circuit board, of a recording material feeding rotatable member provided in said feeding path, and wherein, as seen in a direction perpendicular to a surface of said electric circuit board on which the electrical elements are provided, said recording material feeding rotatable member is overlapped with the surface of said electric circuit board.

4. An apparatus according to claim 3, wherein said electric circuit board is provided at a rear side of a main assembly of said image forming apparatus and extends substantially perpendicularly to a surface on which said image forming apparatus is placed.

5. An apparatus according to claim 3, wherein the plane parallel with the surface of said electric circuit board also passes through a rotational center of said recording material feeding rotatable member.

6. An apparatus according to claim 3, further comprising an image bearing member, a roller contacting said image bearing member to transfer an image formed on said image bearing member onto the recording material, a fixing roller configured to fix the image transferred by said transfer roller on the recording material, and a feeding roller configured to feed the recording material to a contact portion between said image bearing member and said transfer roller, wherein said recording material feeding rotatable member is at least one of said transfer roller, said fixing roller and said feeding roller.

7. An apparatus according to claim 3, wherein the tallest electrical element is a low voltage source element.

8. An apparatus according to claim 6, wherein the tallest electrical element is disposed below said transfer roller in the vertical direction.

9. An apparatus according to claim 3, wherein said electric circuit board is provided with a low voltage source element and a high voltage source element.

10. An apparatus according to claim 6, further comprising an exposing unit configured to form an electrostatic latent image on said image bearing member, wherein said exposing unit extends substantially perpendicular to a surface on which said image forming apparatus is placed, and extends substantially in parallel with a surface of said electric circuit board.

* * * * *